United States Patent [19]

Konther et al.

[11] 4,178,885

[45] Dec. 18, 1979

[54] ROTARY PISTON/CYLINDER ENGINES

[76] Inventors: Siegfried Konther, Rua Azara; Sigfrido Konther Chamorro, Rua Cerro Cora; Udi Konther Chamorro, Rua Cerro Cora, all of, San Lorenzo, Paraguay

[21] Appl. No.: 808,419

[22] Filed: Jun. 20, 1977

[51] Int. Cl.[2] ..... F02B 57/06

[52] U.S. Cl. ..... 123/44 C

[58] Field of Search ..... 123/44 R, 44 C, 43 R

[56] References Cited

U.S. PATENT DOCUMENTS

| | | | |
|---|---|---|---|
| 998,284 | 7/1911 | Ebersole | 123/44 C |
| 1,236,275 | 8/1917 | Dickson | 123/44 C |
| 1,299,662 | 4/1919 | Beggs | 123/44 C |
| 1,980,924 | 11/1934 | McDonald | 123/44 C |
| 3,851,630 | 12/1974 | Foster | 123/44 C X |
| 3,931,809 | 1/1976 | Corte et al. | 123/44 C X |

FOREIGN PATENT DOCUMENTS

| | | | |
|---|---|---|---|
| 263310 | 8/1913 | Fed. Rep. of Germany | 123/44 C |

*Primary Examiner*—Michael Koczo

*Attorney, Agent, or Firm*—Ladas, Parry, Von Gehr, Goldsmith & Deschamps

[57] ABSTRACT

A rotary piston/cylinder engine comprises a rotor assembly which is mounted to rotate about an axis of rotation and comprises a double-headed piston member and a double-headed cylinder member defining two cylinders in which two pistons of the piston members reciprocate respectively. One of the members is mounted to rotate about the axis of rotation of the rotor assembly, while the other member is mounted to rotate about a crank axis which is offset from the axis of rotation of the rotor assembly. Thus, the pistons reciprocate relative to the cylinders as the rotor assembly rotates.

13 Claims, 4 Drawing Figures

ROTARY PISTON/CYLINDER ENGINES

This invention relates to rotary piston/cylinder engines.

Rotary engines having rotating cylinders and a static crankshaft have previously been used as aircraft engines; however, such engines were unsuccessful because of their high cost of manufacture and because they were highly sensitive and therefore unreliable.

According to the present invention, there is provided a rotary piston/cylinder engine comprising:

support means defining an axis of rotation and provided with static crankshaft means defining a crank axis which is offset from said axis of rotation; and a rotor assembly which is mounted by said support means to rotate about said axis of rotation and comprises a double-headed piston member having two pistons at opposite ends respectively of an intermediate portion of the piston member and a double-headed cylinder member defining two cylinders in which the two pistons are fitted respectively, one of said members being connected to said crankshaft means to rotate about the crank axis defined thereby and the other member being rotatable about said axis of rotation, whereby each piston reciprocates relative to the cylinder in which it is fitted as the rotor assembly rotates about said axis of rotation.

The present invention may be used to provide a rotary engine of the type having rotating cylinders and a static crankshaft which may be manufactured in a simple manner and which functions reliably.

For a better understanding of the invention, and to show how the same may be carried into effect, reference will now be made, by way of example, to the accompanying drawings in which.

In the different figures, like reference numerals denote like components.

Figure 1:
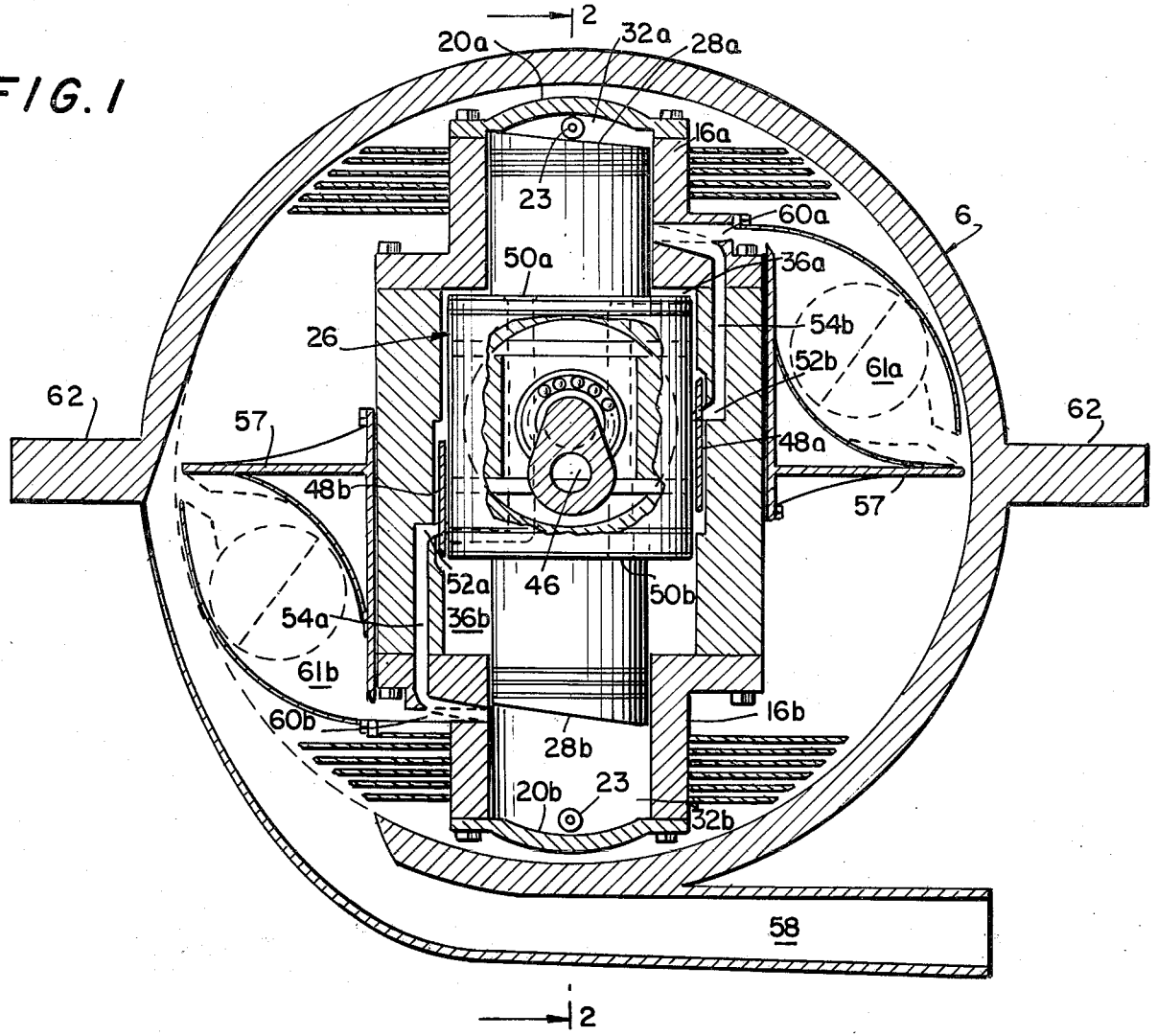
FIG. 1 shows a schematic view, partly in section and partly in elevation, of a first rotary engine embodying the present invention.
Figure 2:
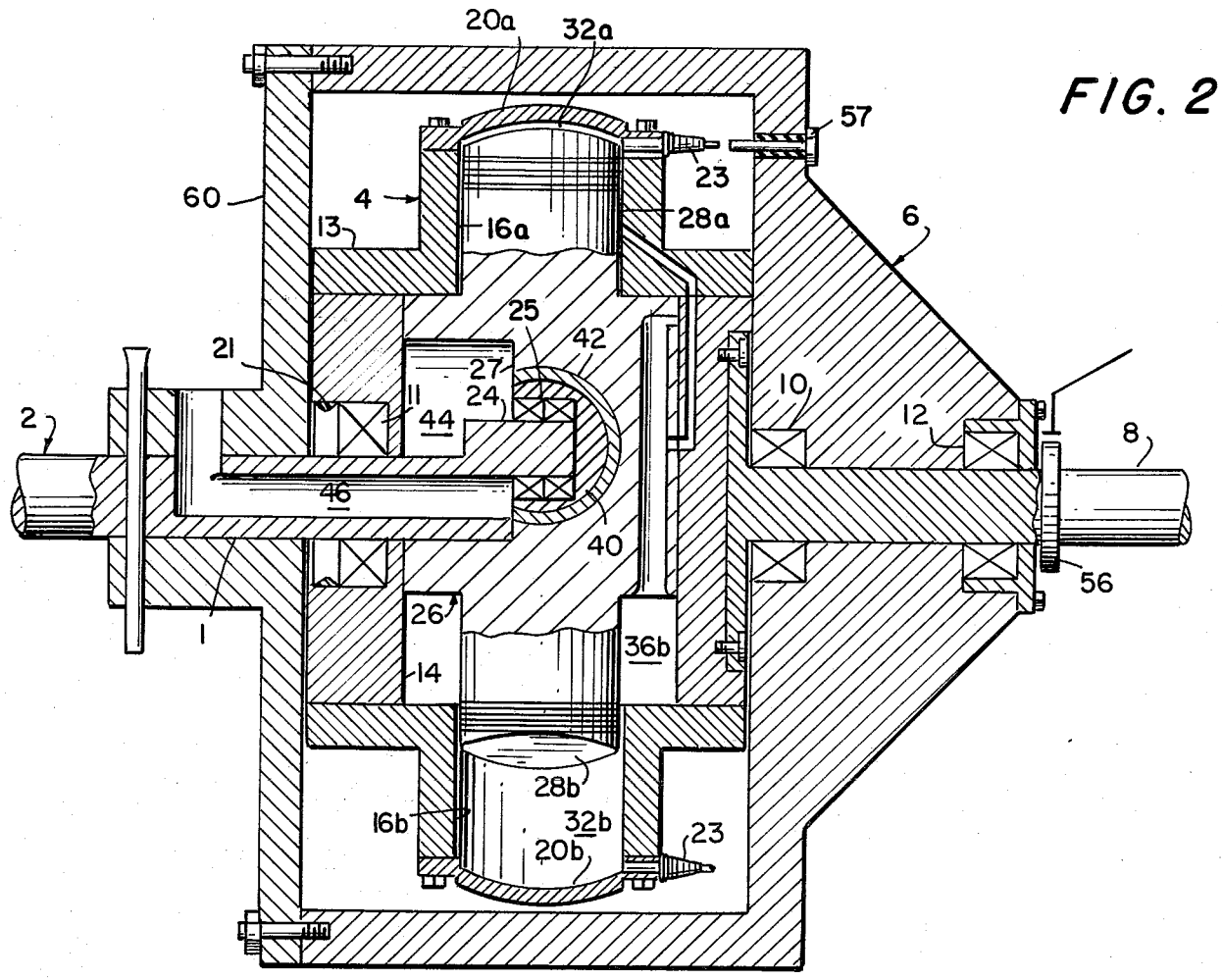
FIG. 2 shows a view taken on the line II—II of FIG. 1.

The engine illustrated in FIGS. 1 and 2 comprises a housing 6 supported by means of lateral flanges 62 and to which is mounted a stationary crankshaft 2 having a main bearing journal pin 1 and a free crank pin 24. Axially aligned with the journal pin 1 is a driven shaft 8 which is rotatably supported in the housing 6 by main bearings 10 and 12. A rotor 4 which is positioned within the housing 6 is flange-connected to the shaft 8 and is mounted to rotate about the pin 1 on a bearing 11. The rotor 4 comprises a cylinder member 13 having a central cylinder barrel 14 and two further cylinder barrels 16*a* and 16*b* which each have a smaller diameter than the barrel 14 and are bolted to opposite ends of the barrel 14. The walls of barrels 16 are provided on the outside with cooling fins as shown in FIG. 1. The open ends of the cylinder spaces are closed by means of cylinder caps 20*a*, 20*b* through which spark plugs 23 project in conventional manner into the combustion space. A double piston member 26, shown in elevation, has a central portion 27 disposed in the barrel 14 and two end pistons 28*a* and 28*b* of smaller diameter than the portion 27 and disposed opposite each other in the barrels 16*a* and 16*b* respectively. The pistons 27, 28*a* and 28*b* cooperate in known manner with the cylinder spaces within rotor 4, so that there are formed two cylindrical combustion spaces 32*a* and 32*b*, and two annular precompression spaces 36*a* and 36*b*.

With each stroke of the double piston member 26 in the cylinder member 4, one of the combustion spaces 32 and one of the precompression spaces 36 are simultaneously compressed, while the other combustion space and precompression space are compressed on the next stroke. The stroke of the piston member 26 within the cylinder member 13 is equal to twice the eccentricity of the crankshaft 2.

A cross-head or carriage 40 is mounted to rotate about the free crank pin 24 on a roller bearing 25. The carriage 40 is of cylindrical shape and is capable of reciprocating perpendicularly with respect to the axis of the piston member 26 within a bronze slide sleeve 42 arranged in the piston member 26, as particularly shown in FIG. 1. The stroke of the carriage 40 within the sleeve 42 must be at least as large as the stroke of piston member 26.

The piston member 26 is formed with a space 44 in order to permit the piston member to rotate freely about the pin 24 without obstruction by the crank web. The space 44 communicates with a carburetor (not shown) by way of an axial conduit 46 provided in the main bearing journal pin 1.

The illustrated engine is a two-stroke engine, and in accordance with conventional practice the fuel that is fed into the space 44 contains a small proportion of oil which lubricates the bearings 11 and 25, and also lubricates movement of the carriage 40 in the sleeve 42. Escape of fuel from the space 44 into the housing 6 is prevented by a seal 21. The fuel may comprise a mixture of naphtha and oil.

The feeding of fuel to the combustion spaces by way of said conduit 46 is described in the following.

Fuel mixture is fed from space 44 by way of a passage 48*a* or 48*b* into the precompression chamber 36*a* or 36*b*. FIG. 1 shows the piston member 26 in a position in which the passage 48*b* is in communication with the precompression space 36*b*. The passages 48 are controlled in known manner by the edges of central piston portion 27, so that each time one of the piston portions 28, for example the portion 28*a*, is at top dead center (i.e. the piston member 26 is at one or other extreme end of its stroke relative to the cylinder member 13 and the other piston portion 28*b* is at bottom dead center) the passage 48 establishes communication between the space 44 and the precompression chamber 36 on the other side of the portion 27 from the portion 28 that is at top dead center. Thus, as shown in FIGS. 1 and 2, the portion 28*a* is at T.D.C. and communication is established between the space 44 and the chamber 36*b* by way of the passage 48*b*.

Pre-pressurizing chambers 50*a* and 50*b* are formed within the central piston portion 27. The pre-pressurizing chambers are in communication with the precompression chambers 36*a* and 36*b* respectively, and each chamber 50 is provided with a radial opening which is normally closed by the cylinder wall, but is capable of registering with a through passage 52*a* and 52*b* formed in the cylinder barrel 14 when the piston member 26 is in a predetermined position. As shown, the radial opening of the chamber 50*a* registers with the passage 52*a* when the piston member 28*a* is at T.D.C., so that the associated precompression chamber 36a has minimum volume. The through passages 52a and 52b open out into respective feeding conduits 54a and 54b which extend within the walls of the cylinder barrels and feed into the combustion spaces 32b and 32a respectively. Although the passages 48 appear in FIG. 1 to be in the same position as the passages 52 and conduits 54, they are in fact offset therefrom about the barrel 14.

A circuit breaker cam ring 56 is arranged on the driven shaft 8 for controlling the spark plugs 23 disposed in combustion spaces 32. The cam ring 56 breaks a circuit including the primary winding of an induction coil (not shown) whenever one of the piston portions 28 is at or near T.D.C. This induces a high voltage in the secondary winding of the coil, and this is fed to an insulated stud 57. The tip of the stud is adjacent the position of the spark plugs 23 when their associated piston portions are at T.D.C., and an arc is established between the stud 57 and the spark plug and accordingly the spark plug fires, causing the fuel in the combustion space 32 to ignite.

Burned gases escape from combustion spaces 32a and 32b by way of exhaust slots 60a and 60b (FIG. 1) and mufflers 61a and 61b. Although the slots 60 appear in FIG. 1 to be in the same position as the openings from the conduits 54, they are in fact offset therefrom about the interior of the barrels 16. The exhaust gases are discharged into the open from the interior of housing 6, together with hot air, by way of a discharge conduit 58.

The housing 6 has a cover plate 60 which supports the crankshaft 2. The plate 60 is formed with openings (not shown) for admitting air to the interior of the housing. Thus, when the rotor 4 rotates, air vanes 57 secured to the rotor serve not only to expel exhaust gases by way of the conduit 58 but also to draw cooling air into the housing for cooling the barrels 16 by means of the cooling fins mounted thereon.

The rotary engine operates as follows: When double piston 26 is in the position shown in FIGS. 1 and 2, fuel mixture will flow from the carburetor (not shown) by way of the axial conduit 46 into the space 44, and will pass from space 44 by way of the passage 48b into the precompression space 36b. Simultaneously, fuel mixture of higher pressure will flow from the pre-pressurizing chamber 50a by way of the through-passage 52a and feeding conduit 54a into the combustion space 32b. The consumed or burned gases are simultaneously discharged by way of exhaust slot 60b.

The combustion space 32a is at this time under maximum compression, and the associated spark plug receives ignition current from the stud 52 to ignite the fuel mixture and cause expansion thereof. The expanding fuel mixture in the combustion space 32a forces the double piston 26 downwardly, and the sliding motion of the carriage 40 in the sleeve 42 converts this compressive force or thrust into a torque about the axis of the main bearing journal pin 1 of the crankshaft 2. The rotor 4 starts to rotate counterclockwise as seen in FIG. 1. After a 90° rotation, the two combustion spaces 32a and 32b are of equal volume, and the carriage 40 is close to the right-hand cylinder wall seen in FIG. 1, which wall is now on top. The pulse of the explosion in the combustion space 32a is sufficient to further rotate the rotor, and to bring the rotor into a position in which the combustion space 32b is now on top, so that the piston portion 28b is at T.D.C., and the fuel mixture present in the space 32b is also compressed, whereupon a new spark will again trigger the above-described cycle.

During the downward motion of the double piston member 26 (relative to the cylinder member 13) from the position shown in FIG. 1, the fuel mixture present in the precompression chamber 36b is compressed until ultimately only the volume of the pre-pressurizing chamber 50b is available to accommodate the fuel mixture. In view of the manner in which the opening of passages is controlled by the double piston member 26, the radial opening of the pre-pressurizing chamber 50b does not register with the through passage 52b until immediately prior to the moment at which the piston portion 23b reaches T.D.C.. The passages 48 also are controlled in such a way that they are cleared only when the double piston member 26 is near or in its extreme positions. In other respects, the mode of operation corresponds with that of a conventional two-stroke engine.

Figure 3:
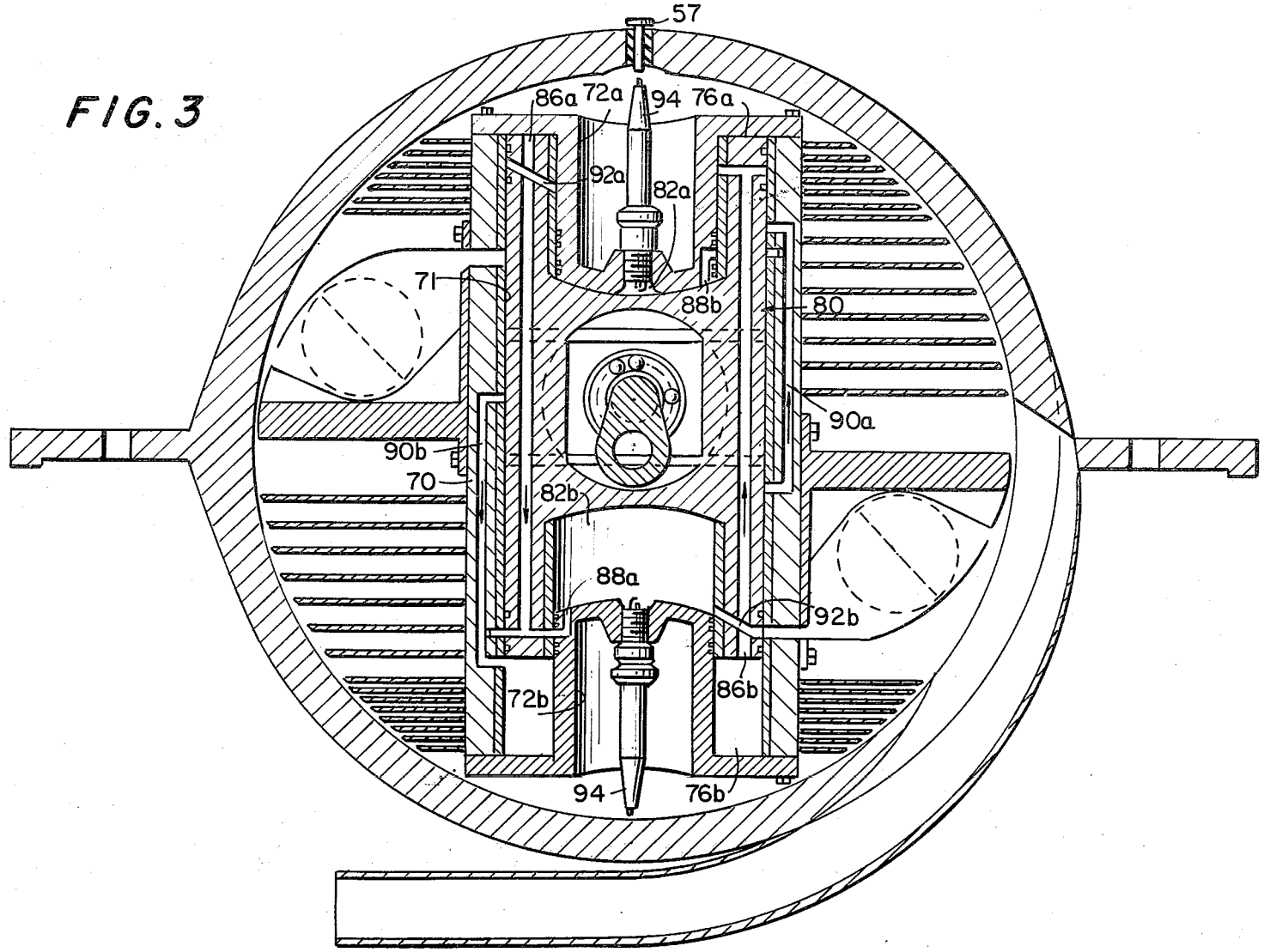
FIG. 3 shows a view similar to FIG. 1 of a second rotary engine embodying the present invention.

In the embodiment shown in FIG. 3 the rotor consists of a cylindrical member 70 defining a bore 71. Two inverted pistons 72a and 72b are bolted to the ends of the member 70 and project into the interior of the bore 71. However, the pistons 72 do not occupy the entire interior space of the cylindrical member 70, but leave annular precompression spaces 76a and 76b around the pistons 72a and 72b respectively. A double cylinder member 80 is supported on the free crank pin 25 of the crankshaft 2 in the same manner as described with reference to the engine shown in FIGS. 1 and 2, and is formed at its two ends with cylinders in which the pistons 72a and 72b are fitted to define respective combustion spaces 82a and 82b. With each rotation of the rotor, the double cylinder member will thus reciprocate relative to the cylindrical piston member 70, thereby alternately decreasing and increasing the volumes of the combustion spaces 82a and 82b.

The double cylinder member 80 is sealed not only with respect to the pistons 72a and 72b, but also with respect to the inner wall of the piston member 70. Therefore, with each compression of the combustion space 82a, for example, the precompression space 76a is also compressed. Pre-pressurizing chambers 86a and 86b are formed in the wall of the double cylinder member 80, which chambers are capable of registering with through passages 88a and 88b in the walls of pistons 72b and 72a by way of respective radially inwardly directed openings. The fuel mixture which is precompressed in the precompression chamber 76a is passed by way of the pre-pressurizing chamber 86a and the passage 88a in the combustion space 82b. The feeding of the fuel mixture from the space 44 into the precompression chambers 76a and 76b is achieved by way of passages 90a and 90b extending in the wall of the member 70 and communicating with the chambers 76a and 76b respectively. The passages 90 are controlled by the edges of the double cylinder member 80 in similar manner to that described in connection with the engine shown in FIGS. 1 and 2.

The exhaust gases are removed by way of exhaust passage 92a and 92b. During removal of exhaust gas from the combustion space 82b, for example, fresh precompressed fuel mixture flows from the precompression chamber 86a by way of through passage 88a into the combustion space 82b; the combustion space 82a is at its minimum volume and the compressed fuel mixture in that space is ignited by means of a spark plug. The expanding gas mixture brings about rotation of the rotor while the double cylinder member 80 is simultaneously reciprocated within the member 70. The spark plugs are conventional, but are provided with adaptor members 94 extending to the vicinity of the housing 6 in order to enable an arc to be established from the stud 57.

An advantage of the engine shown in FIG. 3 resides in the fact that the pistons 72a and 72b may be removed and exchanged in an extremely simple manner, as clearly indicated in FIG. 3. The piston rings may also be exchanged in simple position.

Figure 4:
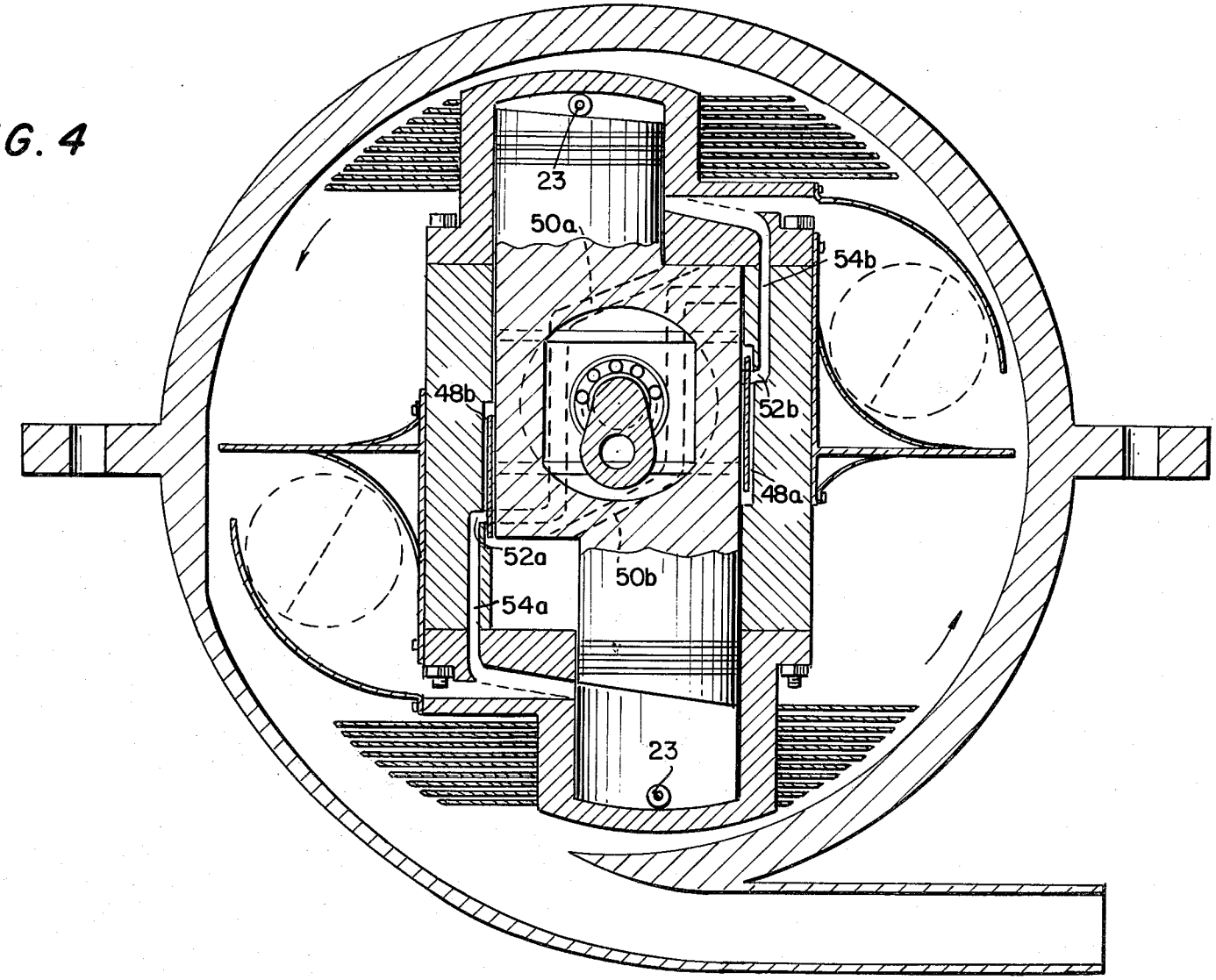
FIG. 4 shows a view similar to FIG. 1 of a third rotary engine embodying the present invention.

The third engine, illustrated in FIG. 4, is similar to the engine illustrated in FIGS. 1 and 2 but the end pistons 28a and 28b are slightly displaced, to opposite sides, relative to the axis of symmetry of the central portion 27 of the piston member 26. The purpose of this modification is to increase the maximum torque produced by the engine. Because of the displacement of the end pistons 28a and 28b, the configuration of the prepressurizing chambers 50 is different from that shown in FIGS. 1 and 2.

The illustrated engines may also be designed as engines with flat-type pistons by which a larger cylinder volume could be achieved while maintaining the same engine dimensions.

As mentioned, the rotary engines described above are two-stroke engines using an oil-naphtha mixture; however, they may be readily adapted to run on gasoline or Diesel fuel.

It is not essential to provide the precompression spaces 36 and 76; the engines would operate having only the main combustion spaces 32 and 82, so long as appropriate passages are provided to introduce fuel mixture into the combustion spaces. However, the illustrated two-stroke engines have the advantage of reliability, and it is not necessary for the piston portions 28 and 72 to suck fuel into the combustion spaces but the fuel is rather forced in under pressure.

The illustrated rotary engines have the special advantage that they work without connecting rods or connecting-rod bearings. Furthermore, they may be operated with either horizontal or vertical axis. Compared to engines with rotating pistons, no sealing and material problems are encountered. Due to the charging of the fuel mixture in the precompression chambers prior to the actual compression stroke, an excellent combustion is achieved.

It is to be understood that the invention is not limited to the specific constructions shown and described, as it will be apparent to those skilled in the art that changes may be made without departing from the principles of the invention as defined in the appended claims.

We claim:

1. A rotary internal combustion engine having a fuel inlet and comprising:

support means defining an axis of rotation and provided with static crankshaft means defining a crank axis which is offset from said axis of rotation; and a rotor assembly which is mounted by said support means to rotate about said axis of rotation and comprises a double-headed piston member having two pistons at opposite ends respectively of an intermediate portion of the piston member and a double-headed cylinder member defining two cylinders in which the two pistons are fitted respectively to define two combustion chambers, the piston member and the cylinder member defining two precompression spaces in addition to the combustion chambers, the cylinder member being connected to said crankshaft means to rotate about the crank axis defined thereby and the piston member being rotatable about said axis of rotation, whereby each piston reciprocates relative to the cylinder in which it is fitted as the rotor assembly rotates about said axis of rotation, said piston member being formed with a bore extending therewithin and having said cylinder member fitted reciprocably therein, said piston member being provided with said two pistons projecting into the interior of the bore at the two ends respectively of the piston member, said cylinder member being formed at its two ends with respective cyinders in which said pistons are fitted respectively, and at least one of said members being formed with passage means which establish communication between the fuel inlet and the two precompression spaces and between the two precompression spaces and the combustion chambers respectively, and which enable gas to be exhausted from the combustion chambers, and wherein each precompression space is at the opposite end with respect to the intermediate portion from the combustion chamber with which it communicates by way of said passage means.

2. An engine as claimed in claim 1, wherein the crankshaft means include a main bearing journal pin which is coaxial with said axis of rotation, a crank pin defining said crank axis and a crank web connecting the pins together, the crank web extending within a space bounded by said cylinder member and communicating with a conduit formed in said main bearing journal pin for feeding fuel to said space.

3. An engine as claimed in claim 1, wherein said piston member is formed with pressurizing chambers for establishing communication between the precompression spaces and the combustion chambers respectively, each pressurizing chamber remaining in communication with the associated precompression space while the piston member reciprocates to reduce the volume of said space, and communication being established between the pressurizing chamber and the associated combustion chamber by way of passages formed in the cylinder member.

4. An engine as claimed in claim 1, further comprising a sleeve which is fitted in said cylinder member, a carriage which is mounted in said sleeve to be slidable therewithin in directions perpendicular to the longitudinal axis of said cylinder member, and a crank pin which defines said crank axis and is received in said carriage.

5. A rotary internal combustion engine having a fuel inlet and comprising:

support means defining an axis of rotation and provided with static crankshaft means defining a crank axis which is offset from said axis of rotation; and a rotor assembly which is mounted by said support means to rotate about said axis of rotation and comprises a double-headed piston member having two pistons at opposite ends respectively of an intermediate portion of the piston member and a double-headed cylinder member defining two cylinders in which the two pistons are fitted respectively to define two combustion chambers, the cylinder member being connected to said crankshaft means to rotate about the crank axis defined thereby and the piston member being rotatable about said axis of rotation, whereby each piston reciprocates relative to the cylinder in which it is fitted as the rotor assembly rotates about said axis of rotation, said piston member being formed with a bore extending therewithin and having said cylinder member fitted reciprocably therein, said piston member being provided with said two pistons projecting into the interior of the bore at the two ends respectively of the piston member, said cylinder member being formed at its two ends with respective cylinders in which said pistons are fitted respectively, the internal diameter of said bore where it surrounds the two piston being greater than the external diameter of the pistons, whereby annular precompression spaces are defined between the pistons and the interior of said piston member, said cylinder member being formed with annular auxiliary piston portions bounding the cylinders respectively and fitted in said precompression spaces respectively, and at least one of said members being formed with passage means which establish communication between the fuel inlet and the precompression spaces and between the precompression spaces and the combustion chambers respectively and which enable gas to be exhausted from the combustion chambers.

6. An engine as claimed in claim 5, wherein the cylinder member is formed with pressurizing chambers for establishing communication between the precompression spaces and the combustion chambers respectively, each pressurizing chamber remaining in communication with the associated precompression space while the cylinder member reciprocates to reduce the volume of said space, and communication being established between the pressurizing chamber and the associated combustion chamber by way of passages formed in the piston member.

7. An engine as claimed in claim 5, wherein the passage means include passages formed in the piston member and controlled by an edge of the cylinder member.

8. An engine as claimed in claim 5, wherein the crankshaft means include a main bearing journal pin which is coaxial with said axis of rotation, a crank pin defining said crank axis and a crank web connecting the pins together, the crank web extending within a space bounded by said cylinder member and communicating with a conduit formed in said main bearing journal pin for feeding fuel to said space.

9. An engine as claimed in claim 5, further comprising a sleeve which is fitted in said cylinder member, a carriage which is mounted in said sleeve to be slidable therewithin in directions perpendicular to the longitudinal axis of said cylinder member, and a crank pin which defines said crank axis and is received in said carriage.

10. A rotary internal combustion engine comprising:

support means defining an axis of rotation and provided with static crankshaft means defining a crank axis which is offset from said axis of rotation;

a rotor assembly which is mounted by said support means to rotate about said axis of rotation and comprises a double-headed piston member having two pistons at opposite ends respectively of an intermediate portion of the piston member and a double-headed cylinder member defining two cylinders in which the two pistons are fitted respectively to define two combustion chambers, one of said members being connected to said crankshaft means to rotate about the crank axis defined thereby and the other being rotatable about said axis of rotation, whereby each piston reciprocates relative to the cylinder in which it is fitted as the rotor assembly rotates about said axis of rotation, the intermediate portion of the piston member being of greater external diameter at its two ends than the pistons, whereby the piston member forms two stepped pistons, and the intermediate portion of the piston member being fitted to reciprocate in an intermediate cylinder defined by the cylinder member, whereby the intermediate cylinder defines two precompression spaces, in addition to the combustion chambers, at opposite ends respectively of the intermediate portion of the piston member, and the central axes of the two pistons being parallel to one another and spaced apart from one another with the axis about which the piston member rotates being disposed in the space between said central axes;

means defining a fuel inlet; and passage means establishing communication between the fuel inlet and the two precompression spaces and between the two precompression spaces and the combustion chambers respectively, said passage means including passages formed in the cylinder member and controlled by an edge of the piston member.

11. An engine as claimed in claim 10, wherein the intermediate portion of the piston member is cylindrical and has two end faces from which the pistons project respectively, and wherein the central axis of the intermediate portion is parallel to the central axes of the two pistons and is disposed therebetween the precompression spaces being defined by said end faces, the pistons and the cylinder member.

12. An engine as claimed in claim 10, wherein the passage means include exhaust passages which extend to the exterior from the combustion chambers, each exhaust passage being controlled by an edge of the piston reciprocating in the associated combustion chamber to be open when the combustion chamber has its maximum volume.

13. A rotary internal combustion engine comprising:

support means defining an axis of rotation and provided with static crankshaft means defining a crank axis which is offset from said axis of rotation;

a rotor assembly which is mounted by said support means to rotate about said axis of rotation and comprises a double-headed piston member having two pistons at opposite ends respectively of an intermediate portion of the piston member and a double-headed cylinder member defining two cylinders in which the two pistons are fitted respectively to define two combustion chambers, one of said members being connected to said crankshaft means to rotate about the crank axis defined thereby and the other being rotatable about said axis of rotation, whereby each piston reciprocates relative to the cylinder in which it is fitted as the rotor assembly rotates about said axis of rotation to vary periodically the volume of the combustion chamber defined by the piston and cylinder, and the cylinder member and the piston member defining two precompression spaces in addition to the combustion chambers, said precompression spaces being at opposite ends respectively of the intermediate portion of the piston member and the volume of each precompression space varying in phase with the variation in volume of the combustion chamber defined by the pistion that is at the same end of said intermediate portion as said precompression space, and the central axes of the two pistons being parallel to one other and spaced apart from one another with the axis about which the piston member rotates being disposed in the space between said central axes;

means defining a fuel inlet; and passage means establishing communication between the fuel inlet and the two precompression spaces and between the two precompression spaces and the combustion chambers respectively, said passage means including passages formed in the cylinder member and controlled by an edge of the piston member.

* * * * *